US009676402B2

(12) United States Patent
Le-Corre et al.

(10) Patent No.: US 9,676,402 B2
(45) Date of Patent: Jun. 13, 2017

(54) SYSTEM FOR MONITORING THE OPERATING CONDITIONS OF A TRAIN

(71) Applicant: ALSTOM TRANSPORT TECHNOLOGIES, Levallois Perret (FR)

(72) Inventors: Frédéric Le-Corre, Saint-Gratien (FR); Frédéric Hallonet, La Jarne (FR); Jean-Yves Fargette, Rueil Malmaison (FR)

(73) Assignee: ALSTOM TRANSPORT TECHNOLOGIES, Levallois Perret (FR)

( * ) Notice: Subject to any disclaimer, the term of this patent is extended or adjusted under 35 U.S.C. 154(b) by 0 days.

(21) Appl. No.: 14/958,763

(22) Filed: Dec. 3, 2015

(65) Prior Publication Data

US 2016/0159380 A1 Jun. 9, 2016

(30) Foreign Application Priority Data

Dec. 4, 2014 (FR) ..... 14 61926

(51) Int. Cl.

| | |
|---|---|
| ***G01M 17/00*** | (2006.01) |
| ***B61L 15/00*** | (2006.01) |
| ***B61L 25/02*** | (2006.01) |
| ***B61L 27/00*** | (2006.01) |

(52) U.S. Cl.

CPC ..... *B61L 15/0081* (2013.01); *B61L 15/0027* (2013.01); *B61L 25/025* (2013.01); *B61L 27/0094* (2013.01); *B61L 2205/04* (2013.01)

(58) Field of Classification Search

CPC ..... E01B 35/06; B61K 9/08; G01M 17/08; B60K 35/00; B61F 1/06; B60L 2200/26

USPC ..... 701/19, 29.1, 29.4, 20, 29.2; 340/438

See application file for complete search history.

(56) References Cited

U.S. PATENT DOCUMENTS

| | | | | |
|---|---|---|---|---|
| 8,504,225 | B2 * | 8/2013 | Bieker | G05B 23/0283 701/19 |
| 8,874,304 | B2 * | 10/2014 | Friesen | B61F 5/245 701/20 |
| 2014/0200827 | A1 | 7/2014 | Bhattacharjya | |

FOREIGN PATENT DOCUMENTS

| | | | |
|---|---|---|---|
| DE | 102013105397 | A1 | 11/2014 |
| WO | 2013/121344 | A2 | 8/2013 |

OTHER PUBLICATIONS

Search Report dated Mar. 3, 2015 in FR priority application No. 1461926.

* cited by examiner

*Primary Examiner* — Gertrude Arthur Jeanglaud

(74) *Attorney, Agent, or Firm* — Knobbe Martens Olson & Bear LLP

(57) ABSTRACT

A system includes an onboard device and a ground device. The onboard device incorporates a geolocation device, a plurality of sensors and at least one shaping module for the raw measurement signals delivered by one or more of the sensors to generate at least one formatted signal. The ground device incorporates a computer able to analyze the at least one formatted signal, to generate at least one indicator relative to the track and/or the rolling stock, the indicator making it possible to detect a damage and monitor variations of the damage so as to optimize maintenance of the track and/or rolling stock. The computer is a damage module able to compute the indicator from the at least one formatted signal and a model of the type of the damage monitored.

5 Claims, 3 Drawing Sheets

SYSTEM FOR MONITORING THE OPERATING CONDITIONS OF A TRAIN

CROSS-REFERENCE TO RELATED APPLICATIONS

This application claims priority to French Patent Application No. FR 14 61926 filed on Dec. 4, 2014, the disclosure of which including the specification, the drawings, and the claims is hereby incorporated by reference in its entirety.

TECHNICAL FIELD OF THE INVENTION

The present invention relates to a system for monitoring the operating conditions of a train.

BACKGROUND OF THE INVENTION

The dimensioning of a train is based on hypotheses relative to the conditions under which the train is meant to be operated. For example, the mission profile considered for the train, the quality of the railroad track on which the train will travel, the transported passenger mass, the distances traveled, the blast effect when passing through tunnels or passing by other trains, etc., will be taken into account.

These hypotheses are defined quite far upstream from the operating phase of the train, such that the actual operating conditions can differ from these initial hypotheses.

Furthermore, the European desire to extend mission profiles, the gradual deterioration of tracks, the opening of new lines on which the train travels, the higher occupancy rate, etc. cause the actual operation of a train to differ tremendously from the hypotheses initially formulated.

These deviations have a direct impact on the aging of the train, and consequently, on its maintenance and warranty, both in terms of safety and contractual obligations.

It is therefore necessary to create a knowledge base making it possible to monitor the actual operating conditions of a train, or more generally a fleet of trains, to guarantee the lifetime of the equipment and allow the reliable design of new trains.

The article by H. Tsunashima et al, "Japanese Railway Condition Monitoring Of Tracks Using In-Service Vehicle", CBM conference 2011, discloses a system for monitoring the condition of a railroad track. The train is equipped with different sensors for example making it possible to detect an irregularity in the track from the vertical acceleration and lateral acceleration of the body of the train (the roll angle of the body being measured by using a gyroscope in order to distinguish between an irregularity in the track and an irregularity in the terrain) or, also for example, to detect rail corrugation from the noise measured in the cabin and the computation of the spectral peak. The train is also equipped with a system including a satellite positioning device, of the GPS type, able to implement a localization algorithm of the train on a geographical map to identify the precise location of the train and, consequently, that of a flaw detected by the onboard sensors.

U.S. Pat. No. 8,504,225 B2 discloses a method for determining a remaining lifetime for a component of a rail vehicle operated on a known track. The train is equipped with different sensors making it possible to acquire measurements during the normal operation of the train. In particular, the train is equipped with a satellite localization device making it possible to geographically tag the measurements acquired by the onboard sensors. These measurements are next sent to a remote processing unit, on the ground, able to aggregate the received measurements over time and consequently update the value of a remaining lifetime of a component of the train.

SUMMARY OF THE INVENTION

The present invention aims to propose an improved monitoring system.

To that end, the invention relates to a system for monitoring the operating conditions of a rail vehicle, including an onboard device, incorporating a geolocation device, a plurality of sensors and at least one shaping module for the raw measurement signals delivered by one or more of said sensors to generate at least one formatted signal, and a component on the ground, incorporating a computer able to analyze said at least one formatted signal, generate at least one indicator relative to the track and/or the rolling stock, said indicator making it possible to detect damage and monitor its variations so as to optimize maintenance of the track and/or rolling stock, characterized in that the computer is a damage module capable, from said at least one formatted signal and a model of the monitored damage type, of computing said damage indicator.

According to other advantageous aspects of the invention, the method comprises one or more of the following features, considered alone or according to all technically possible combinations:

- the ground device includes a damage variation module capable, from several values of the damage indicator values obtained at the output of the damage computer, to compute a variation of said indicator.
- the ground device includes a reduction module using an occurrence matrix taking said at least one formatted signal as input, the damage module using said matrix as input.
- a supervision module able to compare, at any moment, the value of damage computed by the damage module and/or the value of a damage variation computed by the damage variation module, relative to an alert threshold and, if said alert threshold is exceeded, the supervision module is able to generate an alert.
- the system includes a database storing damage and/or damage variations, preferably tagged based on the time and/or geographical location.

BRIEF DESCRIPTION OF THE DRAWINGS

The invention will be better understood using the following description, provided solely as a non-limiting example and done in reference to the appended drawings, in which.

DETAILED DESCRIPTION OF SOME EMBODIMENTS

Figure 1:
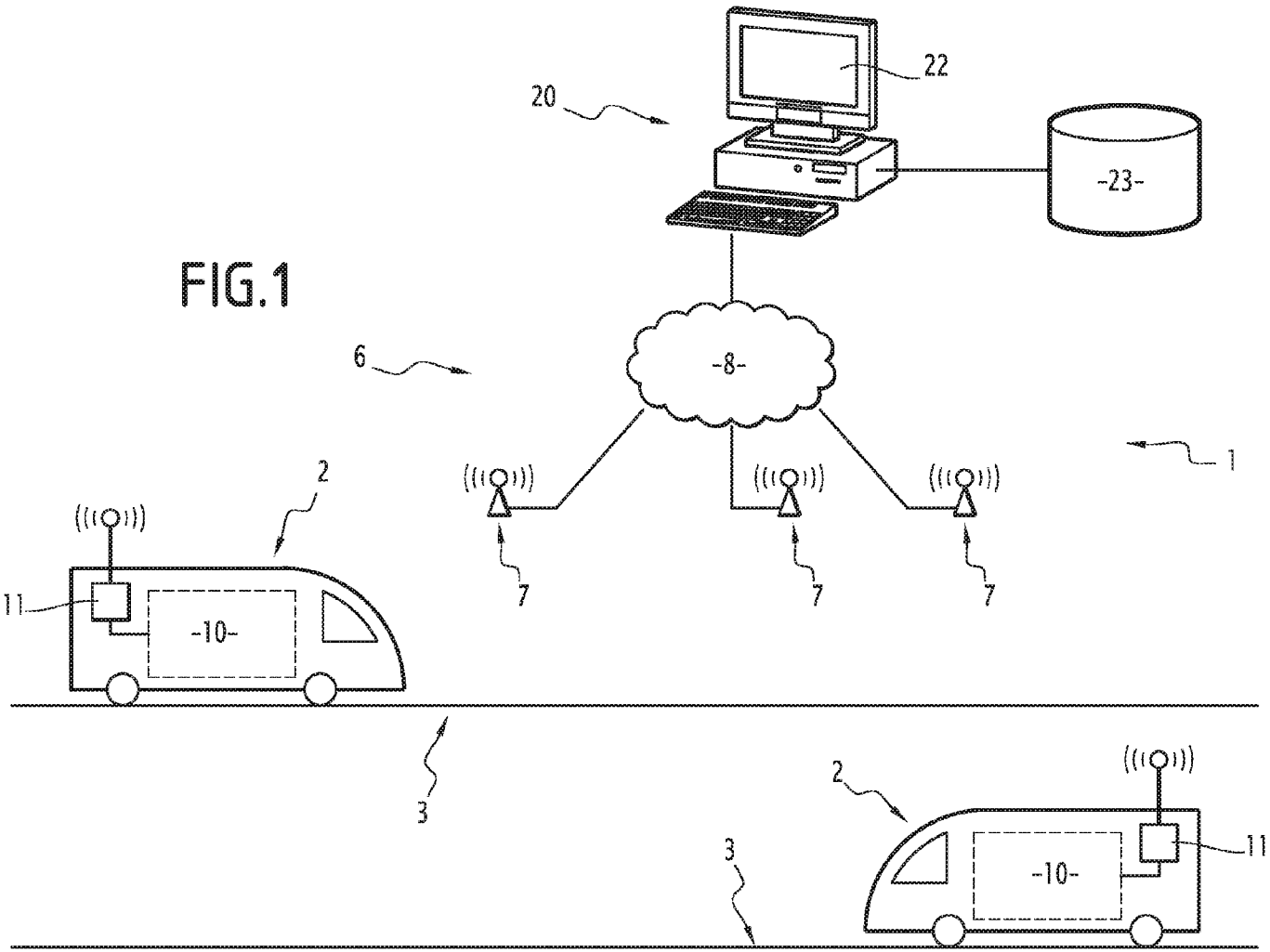
FIG. 1 is a diagrammatic view of the hardware architecture of the system according to the invention.

In general, the monitoring system 1 according to the invention includes an onboard device 10 and a ground device 20, the data collected by the onboard device 10 being communicated to the ground device 20 via a radio communication infrastructure 6.

In a known manner, the communication infrastructure 6 includes, onboard each train in the fleet, a transmission module 11 able to establish a wireless communication with a base station 7, which in turn is connected to a wired network 8. The ground device 20 is also connected to the network 8.

The onboard device 10 includes a geolocation device and a plurality of measuring devices coupled to a plurality of sensors so as to take real-time and continuous measurements of several relevant physical properties. These physical properties are geo-localized and sent to the ground device.

The ground device 20 allows the real-time processing of the measurements of these physical properties that are relevant for medium- and long-term monitoring to evaluate damage and damage variation indicators and for short-term monitoring to detect exceptional events.

Figure 2:
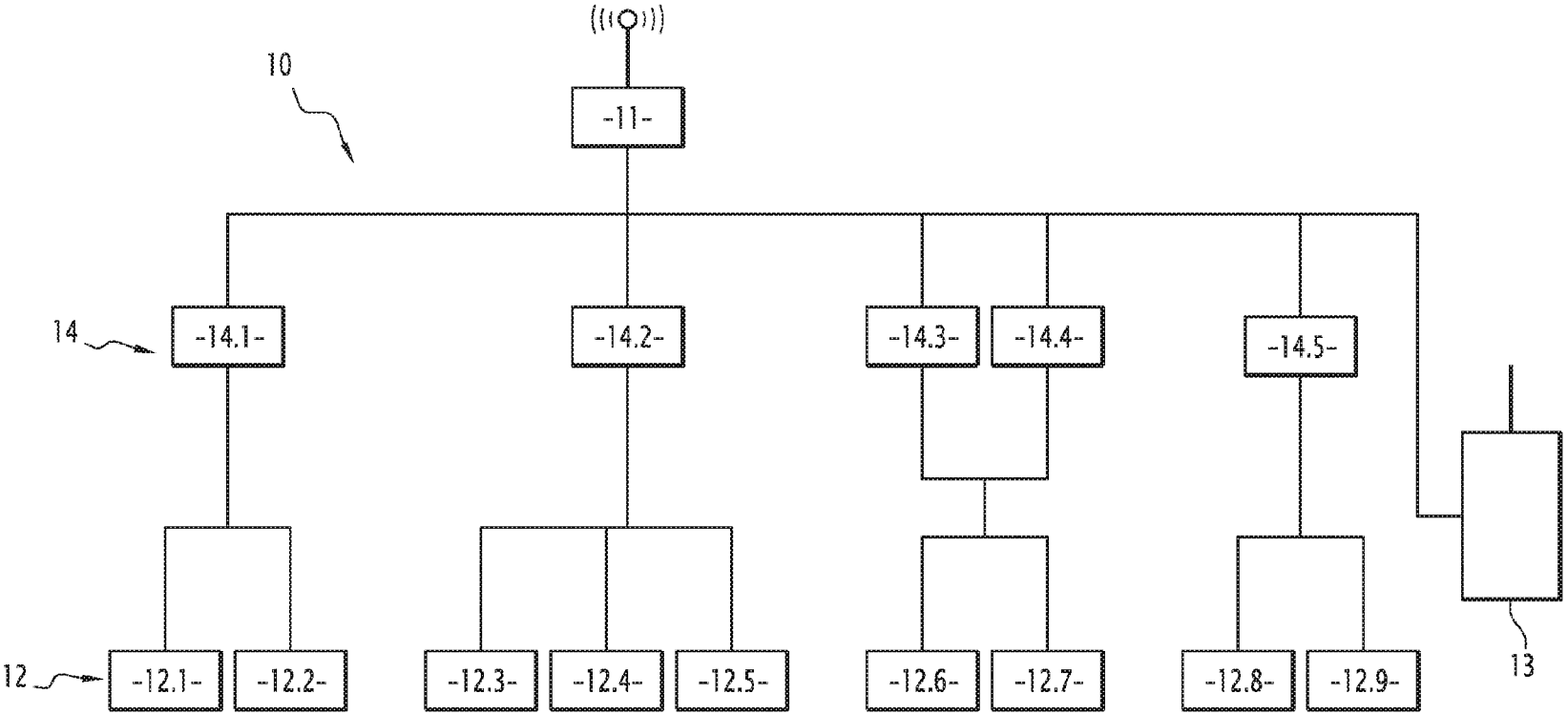
FIG. 2 is a diagrammatic illustration of the onboard device of the system of FIG. 1.

As shown in FIG. 2, for each train 2 of a fleet of trains, the onboard device 10 includes a plurality of sensors 12. The sensors may be made redundant. They are chosen for their relevance in measuring the instantaneous operating condition of a particular component of the train 2, the railroad track 3, or the catenary (not shown in the figures), etc. This choice can result from the first test campaign, making it possible to select a group of sensors from a wide range of possible sensors.

As shown in FIG. 2, a sensor can be an accelerometer 12.1, an optical monitoring means for the track 12.2, a current measurement sensor 12.3, an accelerometer 12.4, imaging means for the surface of a rail 12.5, an accelerometer 12.6, imaging means for welds between rails 12.7, a camera 12.8, a laser system 12.9, etc.

The onboard device 10 includes several modules 14 for shaping raw signals delivered by the different sensors 12. A module 14 makes it possible to associate several incoming raw signals using a suitable mathematical function in order to generate a formatted signal as output, able to be exploited directly by modules of the ground device 20, as will be described below.

In FIG. 2 for instance, the module 14.1 makes it possible to generate a formatted signal corresponding to the instantaneous condition of the railroad track. This signal is developed from raw signals delivered by the sensors 12.1 and 12.2.

Also for example, the module 14.2 makes it possible to generate a formatted signal corresponding to the instantaneous condition of the surface of a rail. This signal is developed from raw signals delivered by the sensors 12.3 to 12.5.

Also for example, the module 14.3 makes it possible to generate a formatted signal corresponding to the instantaneous condition of the welds between two successive rails. This signal is developed from raw signals delivered by the sensors 12.6 and 12.7.

Also for example, the module 14.4 makes it possible to generate a formatted signal corresponding to the instantaneous expansion condition of the welds between two successive rails. This signal is also developed from raw signals delivered by the sensors 12.6 and 12.7.

Also for example, the module 14 makes it possible to generate a formatted signal corresponding to the instantaneous condition of the catenary. This signal is developed from raw signals delivered by the sensors 12.8 and 12.9.

These formatted signals are sent to the ground device 20 via the radio communication interface 6.

Advantageously, each module 14 includes a buffer memory making it possible to record incoming signals over a configurable time window. This window for example has a duration of several hours so as to allow a resumption of the processing of the raw signals, for example in case of interruption of the onboard/ground communication.

The onboard device 10 also includes a satellite localization module 13 of the GPS type, so as to be able to geographically label the formatted signals delivered at each moment by the different modules 14.

The ground device 20 is for example made up of a central computer 22, as shown in FIG. 1.

Figure 3:
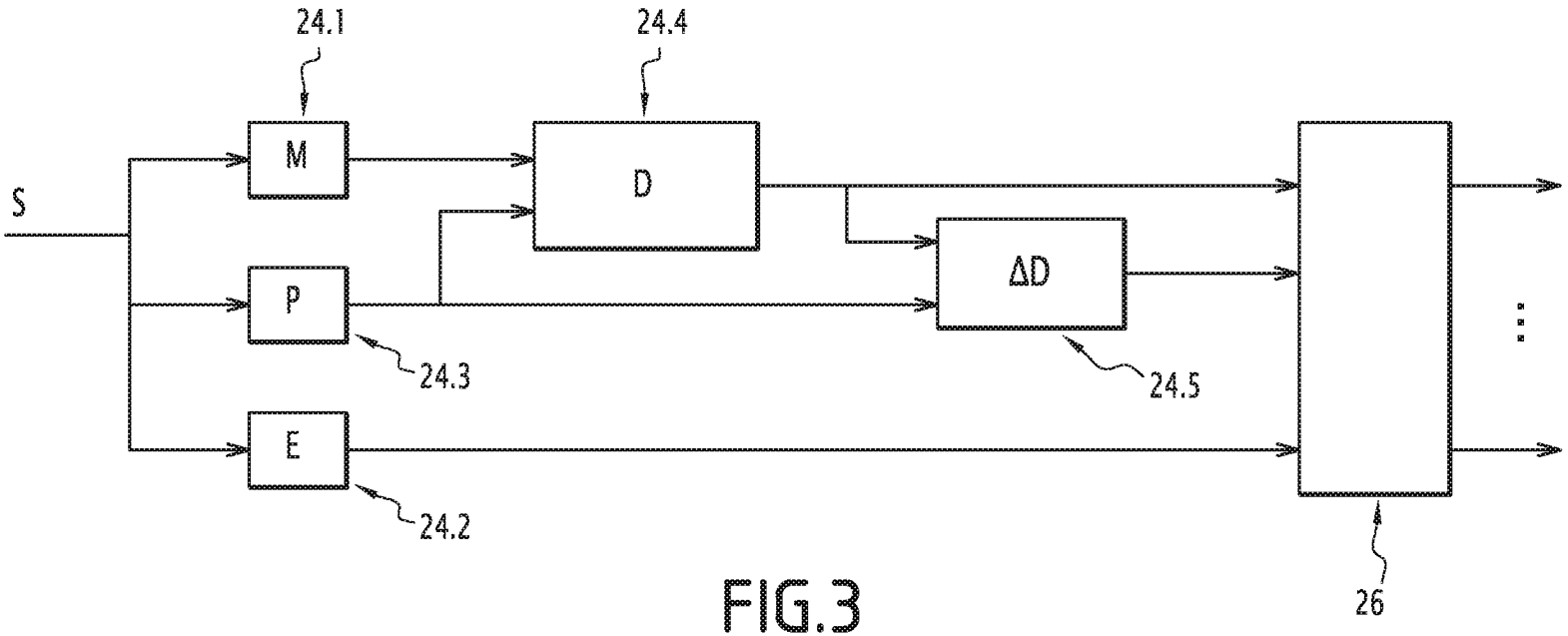
FIG. 3 is a diagram of the processing done by the system of FIG. 1.

This central computer 22 is able to execute different software modules 24, in order to implement the method shown in FIG. 3.

Thus, the central computer 22 includes a module 24.1 for a real-time reduction in the data stream, which makes it possible to considerably reduce the quantity of data corresponding to the formatted signals coming from the onboard device 10 of a particular train 2.

To that end, the module 24.1 is able to account for a formatted signal based on the amplitude. More specifically, the module 24.1 uses an occurrence matrix M, which is a square matrix with N columns Ci. For example, the matrix M is a 64×64 matrix. A column Ci corresponds to a particular formatted signal, each element mi,j of the column Ci being associated with an interval with maximum amplitude dj of the corresponding formatted signal. The value of the element mi,j is equal to the number of occurrences of the formatted signal associated with the column Ci whose maximum amplitude is situated in the interval dj. The occurrence matrix M makes it possible to account for the different forms of the formatted signal for each formatted signal type. The matrix M will be used for middle- or long-term monitoring of a component by a computer 70 able to compute the damage D affecting the monitored train.

The central computer 22 includes a module 24.2 for detecting exceptional events E for short-term monitoring. An exceptional event E is defined when a given formatted signal exceeds an amplitude threshold. This threshold is then defined beforehand by an operator during the configuration of the monitoring system, via a user interface. Advantageously, this threshold depends on the position of the train along the track relative to a predefined origin. By defining a high threshold for a position interval along the track where a fault is known to exist, and a low threshold elsewhere, it is possible to detect the occurrence of new faults on the track.

The central computer includes a module 24.3 recognizing the track on which the train 2 is traveling at the current moment, from the instantaneous position P delivered by the satellite localization module 13 of the train 2 and a set of maps of the railway network on which the train is called upon to travel.

The central computer 22 includes a damage module 24.4 able to compute, from the current value of the occurrence matrix M, kept up to date by the module 24.1 and geographical train positioning and track recognition information kept up-to-date by the module 24.3, a property D relative to mechanical damage that may affect a monitored component. To that end, the module 24.4 uses a fatigue model of the monitored component. This model is chosen from a catalog of possible models, based on the type of damage being monitored: damage due to passages through tunnels, damage due to open-air crossings, etc.

The central computer 22 includes a damage variation module 24.5 able to compute, relative to the time or distance traveled by the train, or for a given track or track profile, a variation in a damage D from a plurality of values of the damage property D at the output of the module 24.4.

The central computer 22 includes a man/machine interface allowing the operator to interact with the system, for example to define the alert threshold values for the damage or their variations and thresholds for defining exceptional events, or for initializing the occurrence matrix M.

The central computer 22 includes a supervisory module 26 able to compare, at each moment, the value of a damage D or the value of a damage variation ΔD relative to an alert threshold. If this alert threshold is exceeded, the module 26 is able to generate a maintenance alert.

Lastly, the ground device includes a database 23 recording:

- the various damage D computed by the damage computation module 24.4 and the variation computation module: absolute damage, relative damage, damage per track, etc.
- the first and any second variations of the damage, relative to the distance traveled or the time or other parameters. This makes it possible to characterize the deterioration speed, and therefore to provide for the next maintenance phase of the rolling stock and/or the track in question, and optionally to detect an acceleration of the deterioration requiring the maintenance phase to be moved up in order to perform a quick intervention to ensure safety.

The indicators computed by the system are more relevant than the mileage traveled by the train alone.

The system makes it possible to analyze both short-lasting events (local defects of track apparatuses creating abnormal stresses, passing alongside another train at high speeds, track movements, etc.) and long-lasting events (aging of the tracks and equipment).

Using these indicators, the lifetime and/or maintenance interval of the train can be optimized, in particular by adapting the mission profile relative to an indicator corresponding to a track stress indicator.

Furthermore, factual data on the track quality of the network is obtained so as to maintain the tracks.

Thus, this monitoring makes it possible to optimize the maintenance of a fleet of trains and detect any appearance of faults on the track abnormally deteriorating passenger comfort and the lifetime of the train.

Furthermore, the builder can have objective information relative to a warranty on the equipment. The contractual warranties can therefore be subject to operations clauses that can be monitored by the system according to the invention.

As the database is enriched, it becomes possible over time to define more realistic operating scenarios for the dimensioning of future products.

What is claimed is:

1. A system for monitoring the operating conditions of a rail vehicle, comprising:

an onboard device onboard said rail vehicle, comprising:

a geolocation device, a plurality of sensors selected for their relevance to measure an instantaneous operating condition of a monitored component of said rail vehicle, each sensor generating a raw measurement signal, and at least one module shaping the raw measurement signals delivered by one or more of said sensors to generate at least one formatted signal corresponding to said instantaneous operating state of said monitored component, and a ground device, comprising a computer analyzing said at least one formatted signal, to generate at least one indicator relative to the monitored component, said indicator making it possible to detect damages and follow variations of said damage so as to optimize a maintenance step of the monitored component, wherein the computer comprises a damage module computing said indicator from said at least one formatted signal and a fatigue model of the monitored component, and wherein the computer of the ground device includes a reduction module using an occurrence matrix taking said at least one formatted signal as input, the damage module using said occurrence matrix as input.

2. The system according to claim 1, wherein the ground device includes a damage variation module computing a variation of an indicator, from several successive values of said indicator generated at the output of the damage module.

3. The system according to claim 1, including a supervision module comparing, at any moment, the value of the indicator computed by the damage module and/or the value of the variation of said indicator computed by the damage variation module, relative to an alert threshold and, when said alert threshold is exceeded, the supervision module generates an alert.

4. The system according to claim 1, including a database storing indicators and/or variations of indicator.

5. The system according to claim 4, wherein indicators and/or variations of indicator are time and/or location stamped.

* * * * *